US008322686B2

(12) United States Patent
Irion et al.

(10) Patent No.: US 8,322,686 B2
(45) Date of Patent: Dec. 4, 2012

(54) APPARATUS FOR APPLYING AND REMOVING RAIL CLIPS ONTO RAIL TIES

(75) Inventors: Allan Irion, Milwaukee, WI (US); William D. Straub, Franklin, WI (US)

(73) Assignee: Nordco Inc., Oak Creek, WI (US)

( * ) Notice: Subject to any disclaimer, the term of this patent is extended or adjusted under 35 U.S.C. 154(b) by 899 days.

(21) Appl. No.: 12/358,866

(22) Filed: Jan. 23, 2009

(65) Prior Publication Data

US 2010/0187486 A1 Jul. 29, 2010

(51) Int. Cl.

| | |
|---|---|
| ***B25C 11/00*** | (2006.01) |
| ***E21B 19/00*** | (2006.01) |
| ***B25B 27/14*** | (2006.01) |
| ***B23P 19/04*** | (2006.01) |

(52) U.S. Cl. ..... 254/18; 254/19; 254/29; 29/278; 29/255

(58) Field of Classification Search ..... 254/18, 254/19, 29; 29/278, 255

See application file for complete search history.

(56) References Cited

U.S. PATENT DOCUMENTS

| | | | | |
|---|---|---|---|---|
| 975,042 | A | | 11/1910 | Jacobs |
| 1,060,173 | A | | 4/1913 | Edwards |
| 1,670,007 | A | | 5/1928 | Rasmussen et al. |
| 2,591,005 | A | | 4/1952 | Piper |
| 3,017,794 | A | | 1/1962 | Pouget |
| 3,064,428 | A | | 11/1962 | Plasser et al. |
| 5,398,616 | A | | 3/1995 | Eidemanis et al. |
| 5,465,667 | A | | 11/1995 | Hosking et al. |
| 5,546,864 | A | * | 8/1996 | Straub et al. ..... 104/17.2 |
| 5,577,447 | A | | 11/1996 | Weber et al. |
| 5,615,616 | A | | 4/1997 | Scheuchzer et al. |

OTHER PUBLICATIONS

Geismar, Technical Specifications Manual, "Four-Head Hydraulic Self-Propelled Coachscrewing Machine With Electronic Control," (Model T2004), pp. 1-5, undated.

* cited by examiner

*Primary Examiner* — Monica Carter
*Assistant Examiner* — Nirvana Deonauth
(74) *Attorney, Agent, or Firm* — Greer, Burns & Crain, Ltd.

(57) ABSTRACT

An apparatus for applying or removing rail clips to secure a rail onto a rail tie including a frame, an operator workstation disposed on the frame, at least one workhead assembly constructed and arranged to move relative to the frame, at least one fastener assembly disposed on the workhead assembly, and at least one paddle assembly disposed on the workhead assembly for working in conjunction with the fastener assembly to push a clip in position for holding the rail to the tie.

20 Claims, 12 Drawing Sheets

APPARATUS FOR APPLYING AND REMOVING RAIL CLIPS ONTO RAIL TIES

BACKGROUND OF THE INVENTION

The present invention relates generally to railroad track maintenance and construction, and more particularly, to an apparatus for applying rail clips onto rail ties, preferably concrete rail ties.

While long accepted in Europe, the use of concrete rail ties to replace wooden ties is becoming more popular in North America. One common installation technique used with concrete ties includes providing the ties with embedded threaded inserts for receiving rail clips and fasteners. The tie, clips and fasteners are provided in an assembled condition. Well-known assemblies of this type are manufactured by Vossloh AG (www.vossloh.com). After placing the rail on the concrete ties, the fasteners are loosened and the rail clips are placed over the rail in a gripping position. The fastener is then tightened until the rail clip and the rail are secured to the concrete tie.

The process of manually installing and removing clips and fasteners to secure rails to ties is tedious and time consuming. These issues led to the development of devices that automatically perform the application of such rail clips. Thus, one design criteria of such an apparatus is to rapidly apply preassembled rail clips. Conventional automated devices require the operator to walk behind the unit.

BRIEF SUMMARY OF THE INVENTION

The present apparatus for applying rail clips onto concrete rail ties features a biasing device urging a paddle towards and engaging the rail tie when a fastener driver reciprocates vertically relative to the rail tie. This engagement reduces the likelihood of the rail clip becoming misaligned and facilitates application of the rail clips. During clip application, the paddle automatically pushes the clip into position prior to the fastener being tightened.

In an alternate embodiment, the apparatus further includes a retention bracket configured to move between a retracted position and a clip engaging position determined by the position of the paddle. The retention bracket includes a track for slidingly engaging a strip on a cylinder mounting bracket mounted to the paddle.

Another feature includes an operator workstation located on a frame of the apparatus, thus providing a convenient location for the operator to operate and monitor the apparatus.

More specifically, an apparatus for applying rail clips to secure a rail onto a rail includes a frame, an operator workstation disposed on the frame, at least one workhead assembly constructed and arranged to move relative to the frame, at least one fastener assembly disposed on the workhead assembly, and at least one paddle assembly disposed to the workhead assembly for working in conjunction with the fastener assembly to push a clip in position for holding the rail to the tie.

In an alternate embodiment, an apparatus for applying or removing rail clips onto rail ties includes a frame, at least one workhead assembly constructed and arranged to move relative to the frame, at least one fastener assembly disposed on the workhead assembly, at least one paddle assembly disposed on the workhead assembly, and at least one paddle included on the paddle assembly and being biased towards the rail tie.

In yet another alternate embodiment, an apparatus for applying or removing rail clips to secure a rail onto a rail tie includes a frame, an operator workstation disposed on the frame, at least one workhead assembly constructed and arranged to move relative to the frame, and at least one fastener assembly disposed on the workhead assembly. At least one paddle mechanism includes a paddle, disposed on the workhead assembly for working in conjunction with the fastener assembly to push a clip in position for holding the rail to the tie, and a retention bracket associated with the paddle mechanism and configured for moving between a retracted position and a clip engaging position determined by a position of the paddle.

In still another alternate embodiment, a paddle mechanism is provided for use with an apparatus for applying or removing rail clips to secure a rail onto a rail tie including a frame, an operator workstation disposed on the frame, at least one workhead assembly constructed and arranged to move relative to the frame, at least one fastener assembly disposed on the workhead assembly, a cylinder mounting bracket disposed on the fastener assembly, at least one fin disposed on the cylinder mounting bracket and having at least one oval-shaped opening for engagement with a pivot pin, and a latch cylinder affixed to the fin the paddle mechanism includes a paddle bracket having a housing and a pair of spaced ears defining a slot therebetween, each ear being wedge-shaped and having a transverse bore constructed and arranged for accommodating the pivot pin and the latch cylinder being accommodated in the slot, the bores of adjacent ears being in registry with each other. A paddle is secured to a lower end of the bracket and includes a first, horizontal panel and a second, vertical panel joined together along a common edge to form a general right angle.

In a further alternative embodiment, a retention bracket is provided for use with an apparatus for applying or removing rail clips to secure a rail onto a rail tie including a frame, an operator workstation disposed on the frame, at least one workhead assembly constructed and arranged to move relative to the frame, at least one fastener assembly disposed on the workhead assembly, at least one paddle assembly disposed on the workhead assembly for working in conjunction with the fastener assembly to push a clip in position for holding the rail to the tie, a cylinder mounting bracket forming a common mount of the paddle assembly and the fastener assembly, and at least one fin disposed on the cylinder mounting bracket having a protruding strip generally parallel to the rail tie and having at least one oval-shaped opening for engagement with a pivot pin. The retention bracket includes at least one sliding portion having a track constructed and arranged to slidingly engaging the strip, and a depending guide portion having a laterally facing guide opening at a first end of the sliding portion for accommodating the pivot pin when the sliding portion engages the strip.

DETAILED DESCRIPTION OF THE INVENTION

Figure 1:
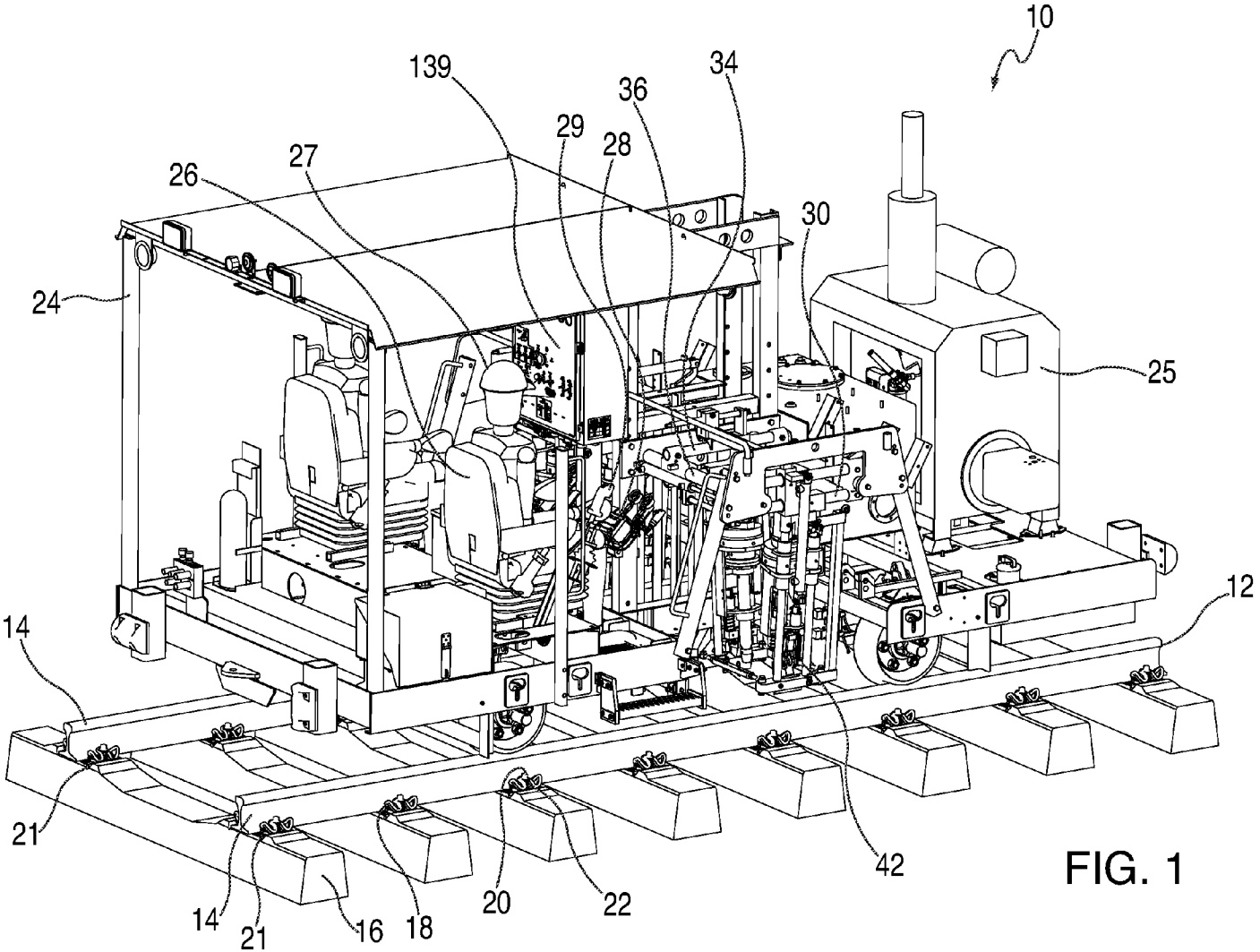
FIG. 1 is a top perspective view of the present apparatus for applying rail clips onto concrete rail ties.
Figure 9:
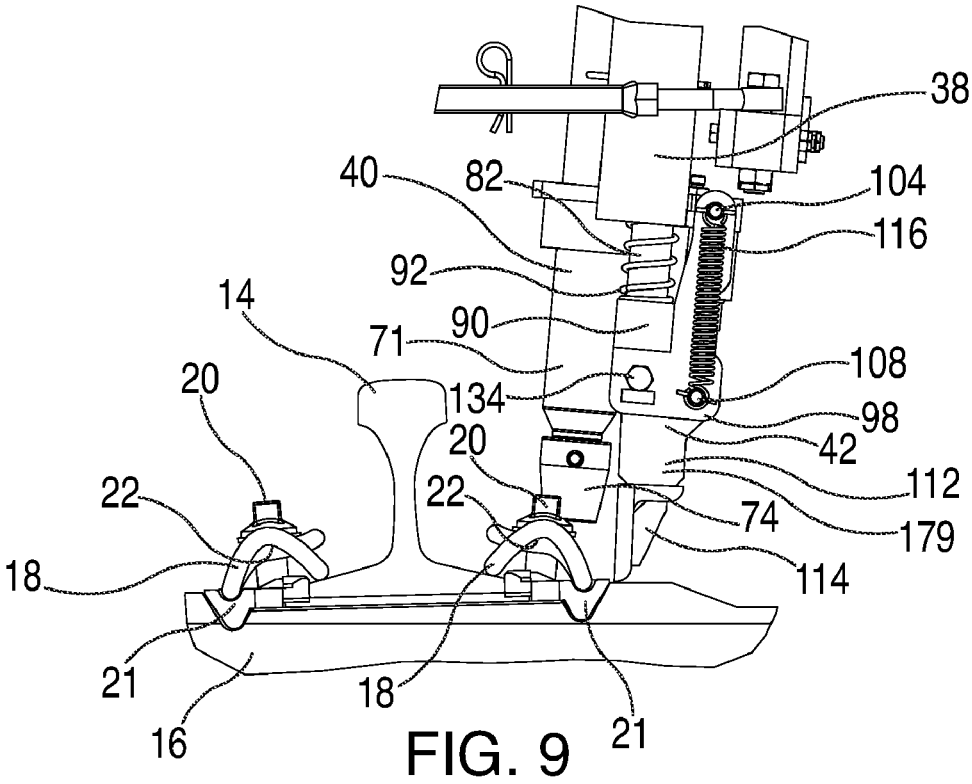
FIG. 9 is an enlarged rear elevation view of the present clip application apparatus of FIG. 1 with portions removed for clarity.

Referring now to FIGS. 1 and 9, a railway maintenance apparatus is generally designated 10 and moves along a railroad track 12 having two parallel rails 14. Supporting the rails 14 are a plurality of railroad ties 16, each positioned generally perpendicular to the rails 14. While concrete ties are preferred, ties of other materials are contemplated. A rail clip 18 is used to secure each tie 16 to the rails 14. Preferably, a set of two rail clips 18 are used to secure each rail 14 to the corresponding tie 16, each of the rail clips being positioned on opposite field and gauge sides of the rail. While a variety of clips are used to secure rails to ties, the present apparatus 10 is designed for use with Vossloh brand clips, which are well known in the art, or their equivalent. A fastener 20, specifically a threaded bolt passes through an opening 22 in the rail clip 18 and into the tie 16 to secure the rail clip and the rail 14 to the tie. As is known in the art, the fastener 20 typically engages a polymeric insert (not shown) located in a bore in the tie 16. Also, the tie 16 is provided with nesting recesses and formations 21 for receiving the clip 18.

The railway maintenance apparatus 10 includes a frame 24 having at least one operator workstation 26 allowing an operator 27 to ride on the apparatus as it moves along the track 12, preferably by employing a motor 25. The frame 24 is provided with other components including wheels for propulsion. Such features are well known in the art and are disclosed in U.S. Pat. No. 5,398,616 to Eidemanis et al. which is incorporated by reference. The operator workstation 26 provides an advantage of comfort and convenience for the operator as opposed to, for example, a conventional apparatus requiring the operator to walk behind and control the apparatus while on foot. At least one control mechanism 28 is positioned near the operator workstation 26, providing the individual with controls such as a hydraulic remote control and hand controller 29 for moving the apparatus 10 and for additional rail maintenance functions, which will be described in further detail below.

The apparatus 10 includes at least one workhead carriage 30 which is constructed and arranged to move at least one workhead assembly 32 parallel and transverse to the rails 14. Workhead carriages of this type are well known in the art (see e.g., U.S. Pat. No. 5,465,667 to Hosking et al, which is incorporated by reference). A first cylinder 34 on the workhead carriage 30 facilitates movement of the workheads 32 in a direction parallel to a longitudinal axis of the rails 14. A second cylinder 36 on the workhead carriage 30 facilitates movement of the workheads 32 in a direction perpendicular to the longitudinal axis of the rails 14.

Figure 2:
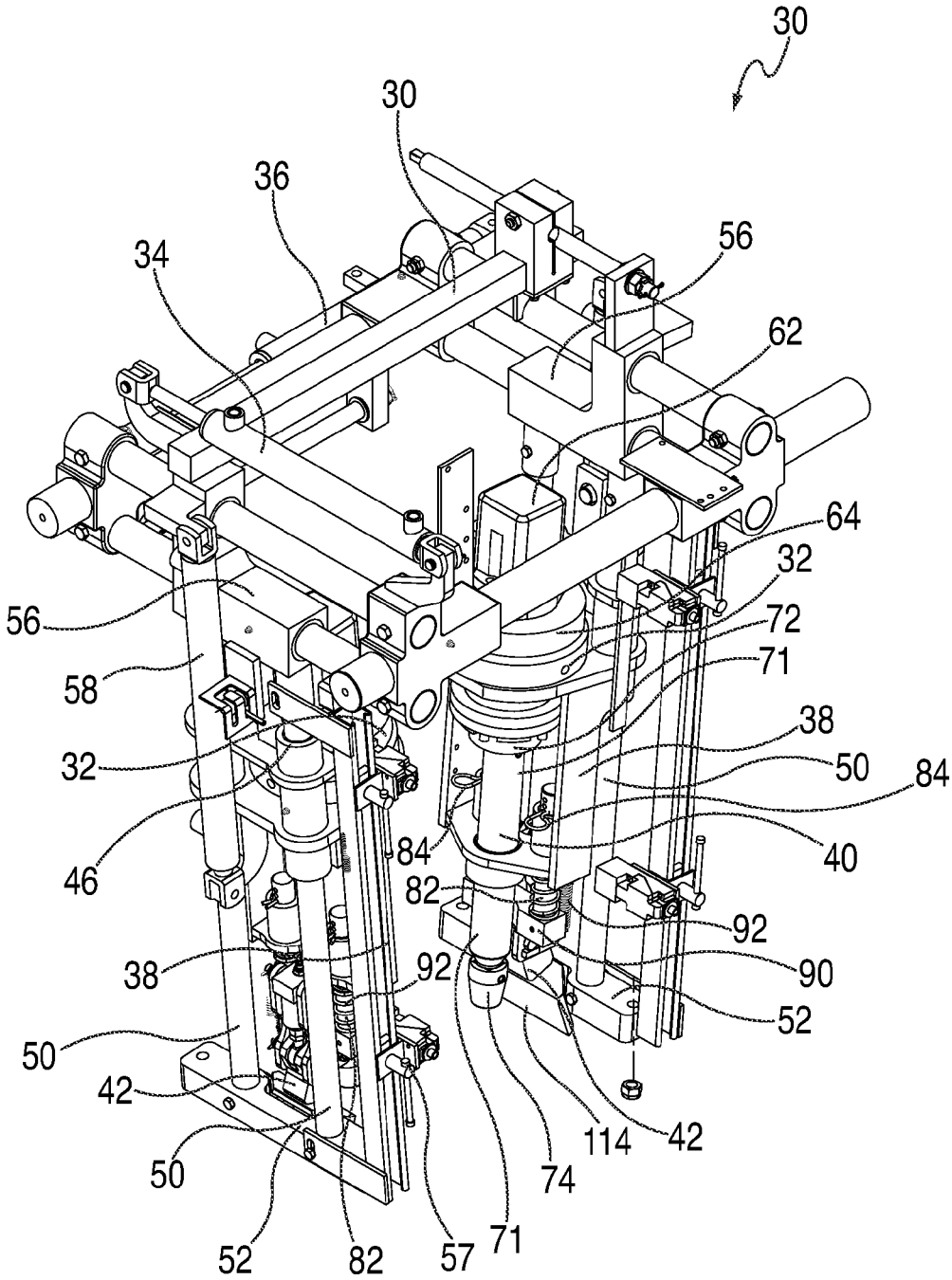
FIG. 2 is a top perspective view of the present apparatus with portions removed for clarity.
Figure 3:
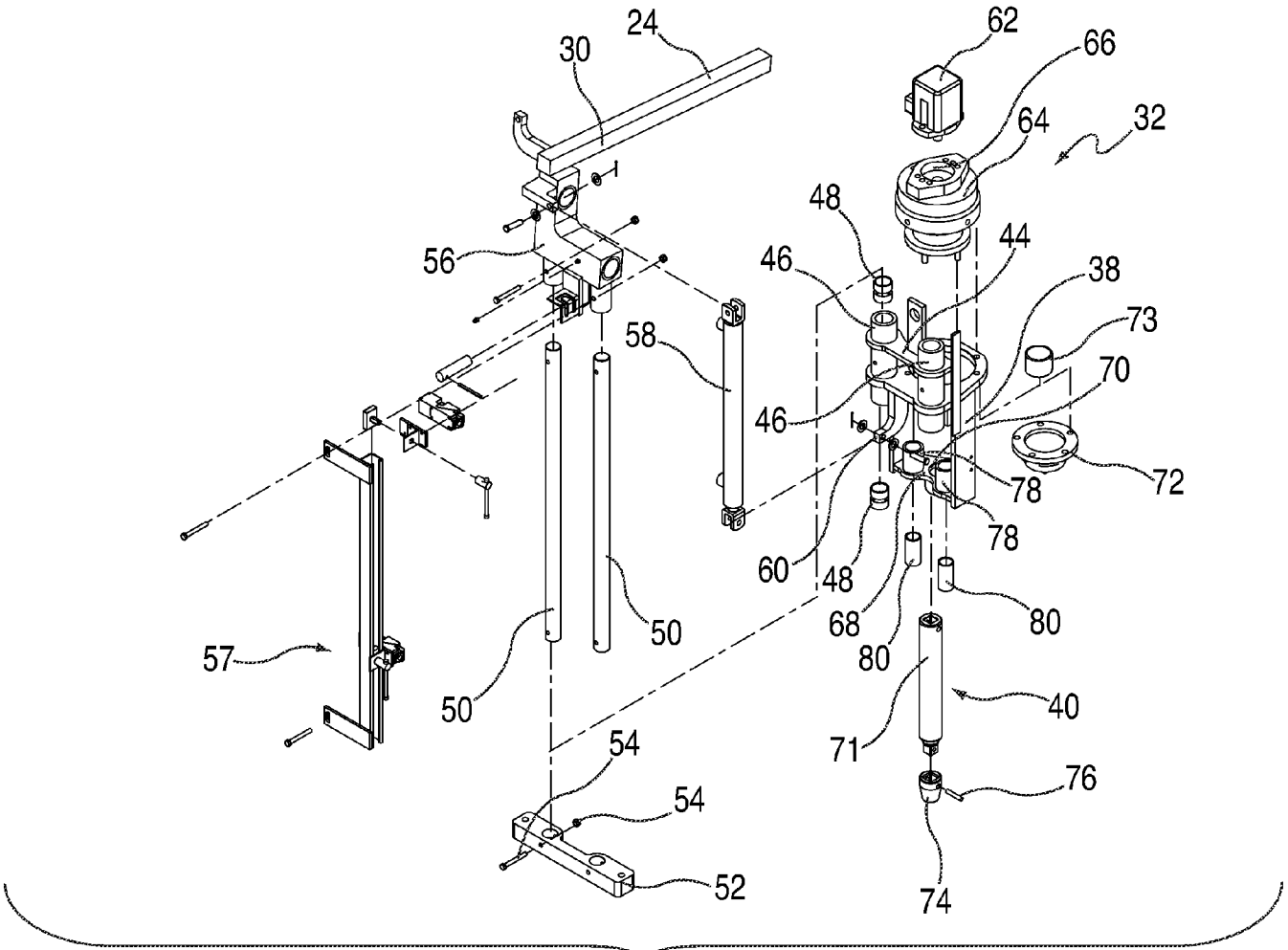
FIG. 3 is a top perspective, exploded view of the apparatus of FIG. 2 with portions removed for clarity.

Referring now to FIGS. 2 and 3, each workhead assembly 32 is configured to move vertically between a travel position and a ready position, which is described in further detail below. The apparatus 10 preferably includes two workhead assemblies 32, each being able to move independently of the other. Included in the workhead assembly 32 is a drive bracket 38 connecting a fastener assembly 40 and a paddle assembly 42 (FIG. 2). At a top end 44 of the drive bracket 38 is at least one, but preferably two generally tubular formations 46, each configured for accepting a guide mounting bushing 48 and one of a pair of guide shafts 50. The parallel orientation of the guide shafts 50 is maintained by a guide bracket 52 using a guide fastener and nut 54 to secure each guide shaft in the guide bracket. Each guide shaft 50 is attached at its other end to a guide block 56 slidably disposed on the workhead carriage 30.

A position sensor assembly 57 is attached to the guide block 56 for monitoring the position of the fastener assembly 32. A driving cylinder 58 engages the guide block 56 at an upper end, and a cylinder bracket 60 at the opposite end, the cylinder bracket preferably being integrated with the drive bracket 38. Thus, extension or retraction of the driving cylinder 58 selectively positions the drive brackets 38 along the guide shaft 50.

Each fastener assembly 40 includes a motor 62, preferably hydraulic, being attached to a drive housing 64 enclosing a transmission (not shown) and having a tubular cavity 66. The drive housing 64 is further attached to the top end 44 of the drive bracket 38. At a bottom end 68 of the drive bracket 38 is a drive shaft opening 70. A drive shaft 71 is powered by the motor 62 through the drive housing 64, and extends through a drive extension adapter 72 disposed in the drive bracket 38, and finally a bushing 73 (FIG. 3) in the drive shaft opening 70 in the drive bracket. A drive socket 74 is secured to a lower end of the drive shaft 71 with drive pins 76, which also secure the drive adapter 72 to the upper end of the shaft 71. The drive shaft 71 and the socket 74 thus rotate relative to the drive assembly 64 under the power of the motor 62.

Figure 4:
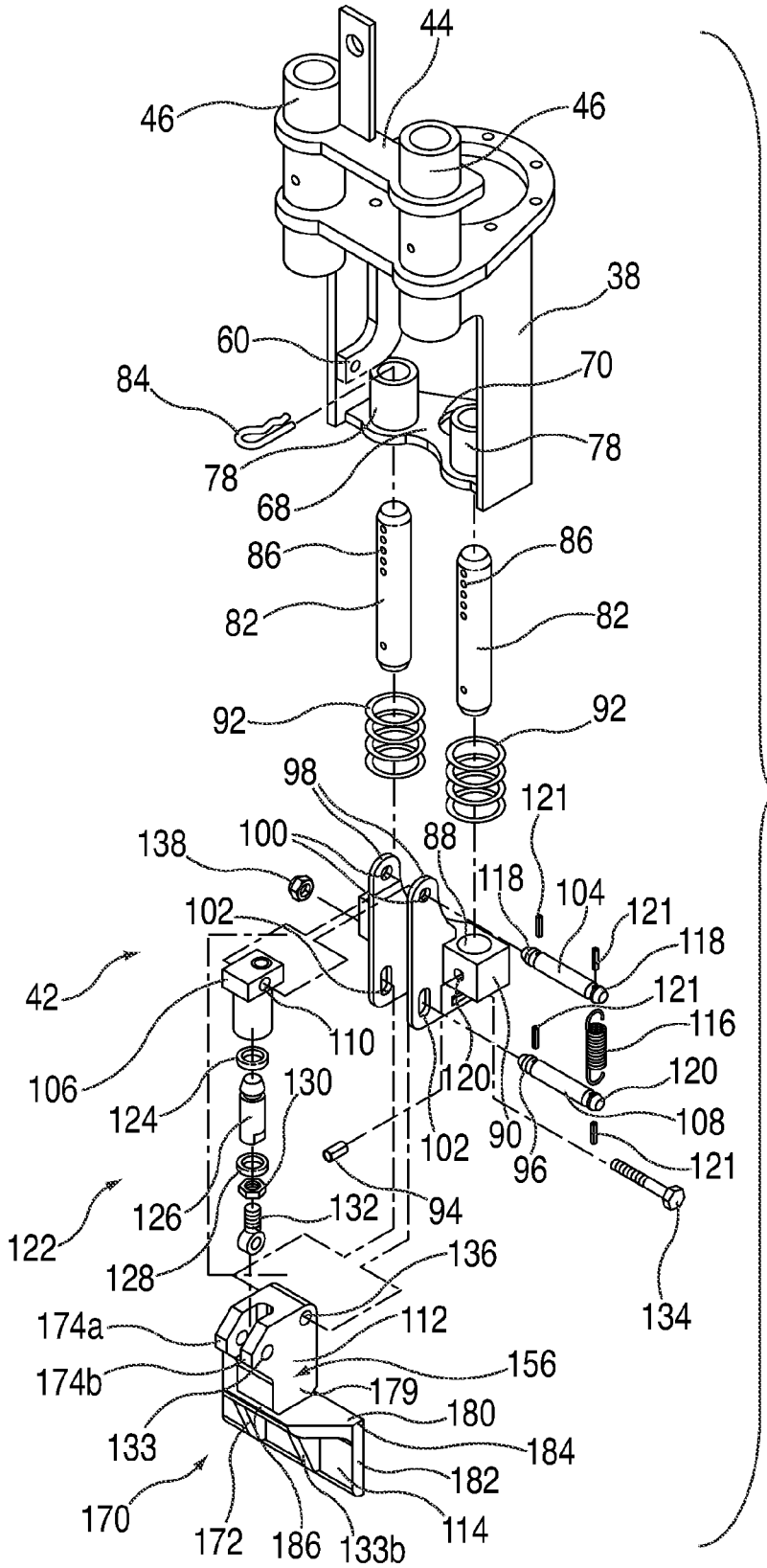
FIG. 4 is an exploded perspective view of the apparatus of FIG. 3 with portions removed for clarity.

Referring now to FIG. 4, at the bottom end 68 of the drive bracket 38 is at least one, but preferably two tubular extensions 78 each configured for accepting a feeder frame bushing 80 (FIG. 3) and a guide rod 82. A releasable positioning cotter pin 84 located above the extensions 78, engages one of a plurality of positioning openings 86 on the guide rod 82, allowing the height of the guide rod and the paddle assembly 42 to be adjusted relative to the drive bracket 38. The guide rods 82 each engage an opening 88 in a cylinder mounting bracket 90. A compression spring 92 accommodates each guide rod 82 and is bound between the drive bracket 38 and the cylinder mounting bracket 90. A compression spring pin 94 holds each guide rod 82 to the cylinder mounting bracket 90. Thus, the cylinder mounting bracket 90 and the guide rods 82 are biased downwardly away from the drive bracket 38, but once the biasing force is overcome, the mounting bracket can move vertically upward towards the top end 44. This enables the fastener assembly 40 to move relative to the mounting bracket 90 once the bracket contacts the tie 16 as will be described below.

Disposed on the cylinder mounting bracket 90 is at least one, but preferably two fins 98. Each fin 98 has a first, generally circular-shaped opening 100 and a second, generally elongate or oval-shaped opening 102. A first pivot pin 104 passes through the circular-shaped opening 100 in the one fin 98, a bore 110 in a cylinder body 106 included on the paddle assembly 42, and finally through the circular-opening 100 in the other fin 98. A second pivot pin 108 passes through the oval-shaped opening 102 in one fin 98 and through a cylindrical-shaped opening 136 in a paddle bracket 112. A paddle 114 is secured to the bracket 112, as by being welded, but other fastening or fabrication techniques are contemplated. The generally planar paddle 114 is constructed and arranged for engaging the clip 18 as will be described in greater detail below. The first pivot pin 104 and the second pivot pin 108 are connected by at least one, but preferably two extension springs 116. Each extension spring 116 connects an end 118 of the first pivot pin 104 to a corresponding end 120 of the second pivot pin 108. Each end of the pivot pins 104, 108 engages each of the respective pairs of openings 100, 102. At least one spring pin 121 is used to retain the pivot pins 104, 108 in the bracket 90.

Connecting the cylinder body 106 on the paddle assembly 42 to the paddle bracket 112 are several parts arranged in linear fashion forming a latch cylinder 122. Included in the latch cylinder 122 is a piston ring 124 mounted on a hydraulic piston 126 and slidably engaging an inner bore (not shown) of the cylinder body 106. A rod wiper 128 is mounted to a lower end of the piston 126, and a hexnut 130 secures a swivel eyelet 132 to a lower end of the piston 126. Pivot pin 108 pivotally holds the eyelet 132 in at least one bores 133 of the paddle bracket 112 in a clevis arrangement. A bolt 134 secures the paddle bracket 112 to the cylinder mounting bracket 90 by passing through a throughbore 136 on the paddle bracket and an opening (now shown) on the cylinder mounting bracket 90. A hex nut 138 secures the bolt 134 in place.

Due to the spaced location of the bore 133 from the opening 136, extension or retraction of the piston 126 causes the paddle 114 to pivot relative to the mounting bracket 90 about the axis formed by the bolt 134. This pivoting action causes the paddle 114 to define an arc of motion (arrow "A" in FIG. 7) as the paddle moves through extension/pressurization of the piston 126. This extension of the piston 126 causes the pins 108 to move in the elongated slots 102. Since the cylinder 122 is single acting, the springs 116 perform a return function upon depressurization of the cylinder as is known in the art, to pull the paddle 114 back to the retracted position of FIGS. 5 and 6.

As previously described, rail clips 18 include fasteners 20, which pass through an opening 22 in the rail clip and into the tie 16 to secure the rail clip and the rail 14 to the tie. Typically, rail clips 18 are shipped and stored attached to the ties 16 with the fasteners 20 tightened. Therefore, the fastener 20 must first be loosened before the rail clip 18 is used to secure the rail 14. Then, once the rail clip 18 is properly aligned over the rail 14 and the tie 16, the fastener is retightened to secure the rail clip and the rail to the tie.

Figure 6:
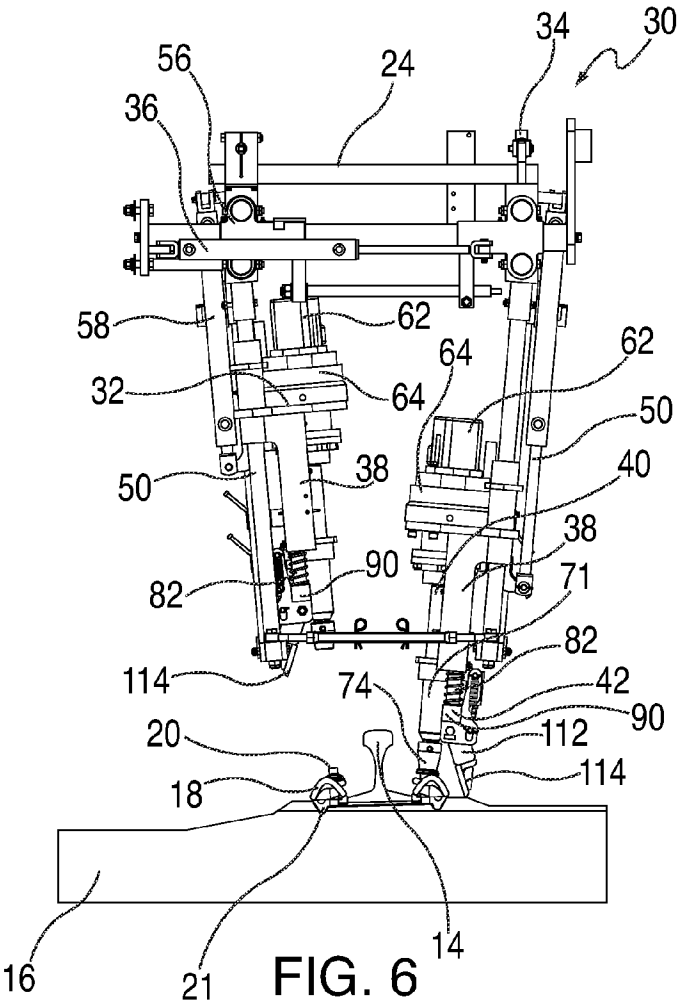
FIG. 6 is a side view of the workhead of FIG. 5 and shown with the fastener tightening assembly in a fastener loosening position and the paddle in a withdrawn position.
Figure 5:
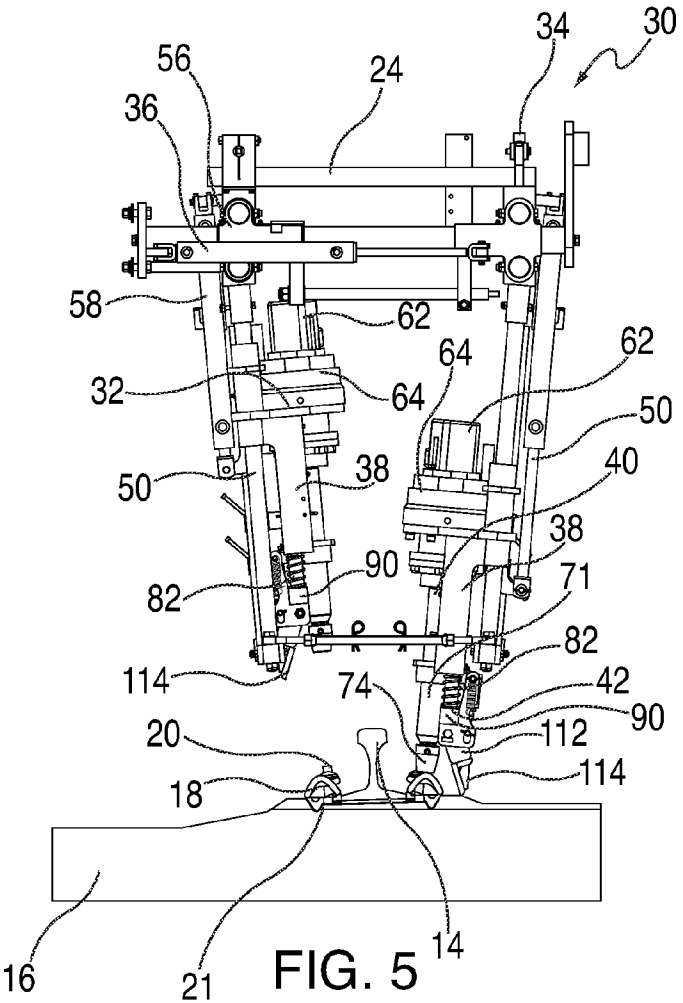
FIG. 5 is a side view of the present workhead of FIG. 1 with portions removed for clarity and shown with a fastener assembly in a fastener tightening position and a paddle in a withdrawn position.
Figure 7:
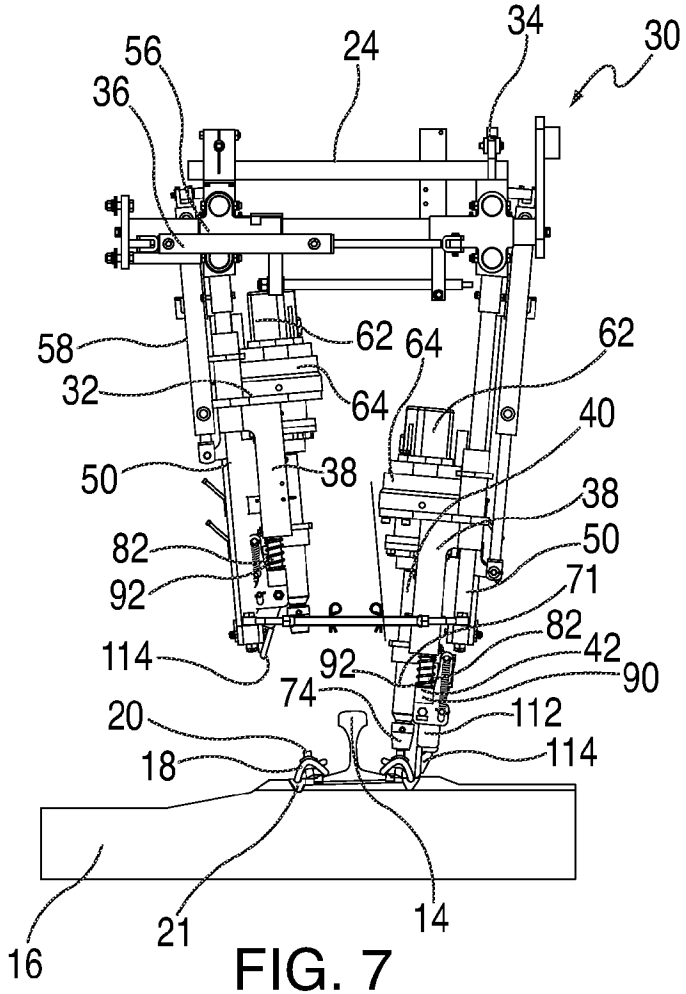
FIG. 7 is a side view of the workhead of FIG. 5 with portions removed for clarity and shown with the fastener assembly in a fastener loosening position and the paddle in a rail clip engaging position.

Referring now to FIGS. 5 and 6, when the workhead assembly 32 is in the ready position, the operator 27 locates the workhead assembly above the target fastener 20 using the hand controller 29. While operation of the present apparatus 10 is described as being controlled by the operator 27, operations can also be performed automatically. While automatic control is preferably controlled by a program logic controller or "PLC" 139 (FIG. 1), other components providing automation are contemplated as known in the art (e.g., circuit boards and/or relays). Upon activation by the operator 27, the fastener assembly 40 moves generally vertically between a fastener tightening position (FIG. 5) and a fastener loosening position (FIG. 6). More specifically, the operator 27 causes the workhead assembly 32 to move into the ready position and the fastener assembly 40 to move into the relatively lower fastener tightening position such that the drive socket 74 engages the fastener 20 (FIG. 5) followed by counter-clockwise rotation of the drive socket 74. This action, which also moves the fastener assembly 40 upward through action of the driving cylinder 58, moves the fastener assembly 40 into the fastener. Next, the operator 27 causes the fastener assembly to move into the relatively higher fastener loosening position, thereby loosening the fastener 20 and freeing the rail clip 18 for movement (FIG. 6).

Figure 10:
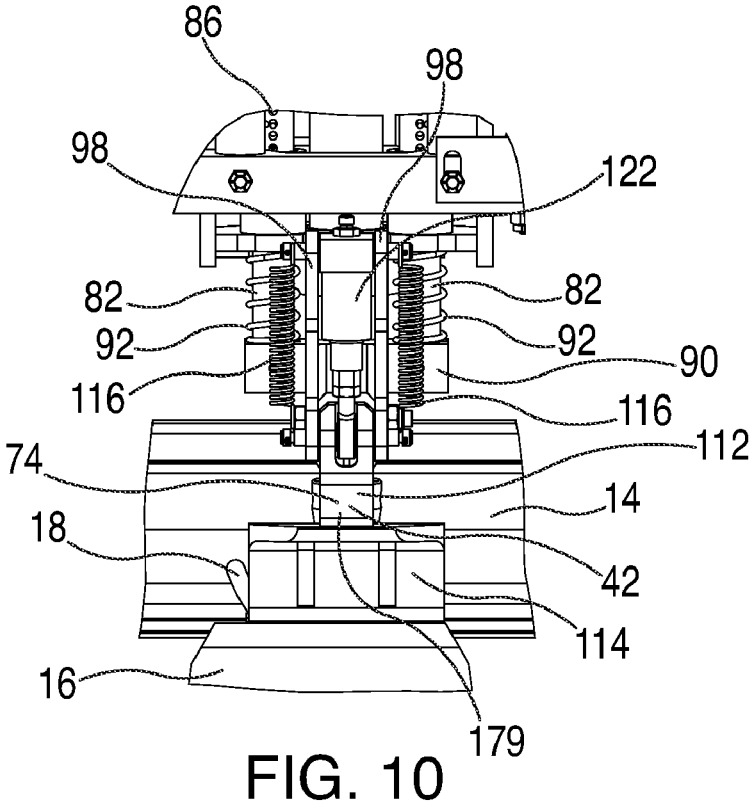
FIG. 10 is an enlarged right side view of the apparatus of FIG. 1 with portions removed for clarity.

Referring now to FIGS. 9 and 10, the operator then causes the paddle assembly 42 to position the clip 18 and the fastener assembly 40 to tighten the fastener 20. The paddle 114 is constructed and arranged for pivoting relative to the drive bracket 38, the common mount of the paddle assembly 42 and the fastener assembly 40, such that when the fastener assembly is in the ready position, the paddle 114 is moveable between a withdrawn position (FIGS. 5 and 6) and a rail clip engaging position (FIGS. 7 and 8), by use of the cylinder 122 which extends around the cylinder mounting bracket 90.

Figure 8:
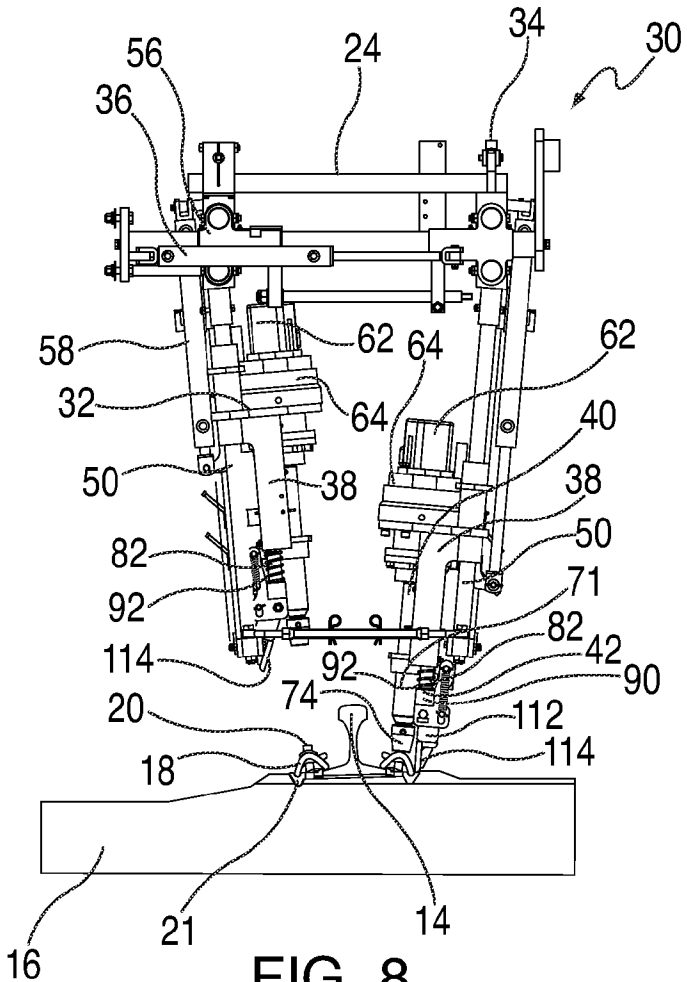
FIG. 8 is a side view of the workhead of FIG. 5 with portions removed for clarity and shown with the fastener assembly in a fastener tightening position and the paddle in a rail clip engaging position.

Once the fastener 20 has been loosened from the rail clip 18 (FIG. 5), the operator 27 causes the paddle 114 to pivot in the direction of arrow "A" into the rail clip engaging position (FIG. 7) where it engages and exerts a pushing force on the rail clip 18. Once the clip 18 is in position, the operator 27 causes the fastener assembly 40 to rotate clockwise, and move into the fastener tightening position to secure the fastener 20 (FIG. 8). As the fastener 20 is being tightened, the fastener assembly 40 moves closer to the tie 16, while the paddle 114 remains in contact with the tie. This relative movement is reflected in the compression of the spring 92 (FIG. 8) As such, the paddle 114 continues to engage and exert a force on the rail tie 16 independent of the movement of the fastener assembly 40 such that the alignment of the rail clip 18 is properly maintained as the fastener 20 is tightened.

The combined use of the fastener assembly 40 and the paddle assembly 40 reduce the likelihood of the fastener 20 and the rail clip 18 becoming misaligned and therefore provide for a more efficient clip application process. Further, the location of the operator workstation 26 on the frame 24 provides a convenient and comfortable location for the operator 27 to facilitate and monitor operation of the present maintenance apparatus.

Figure 11:
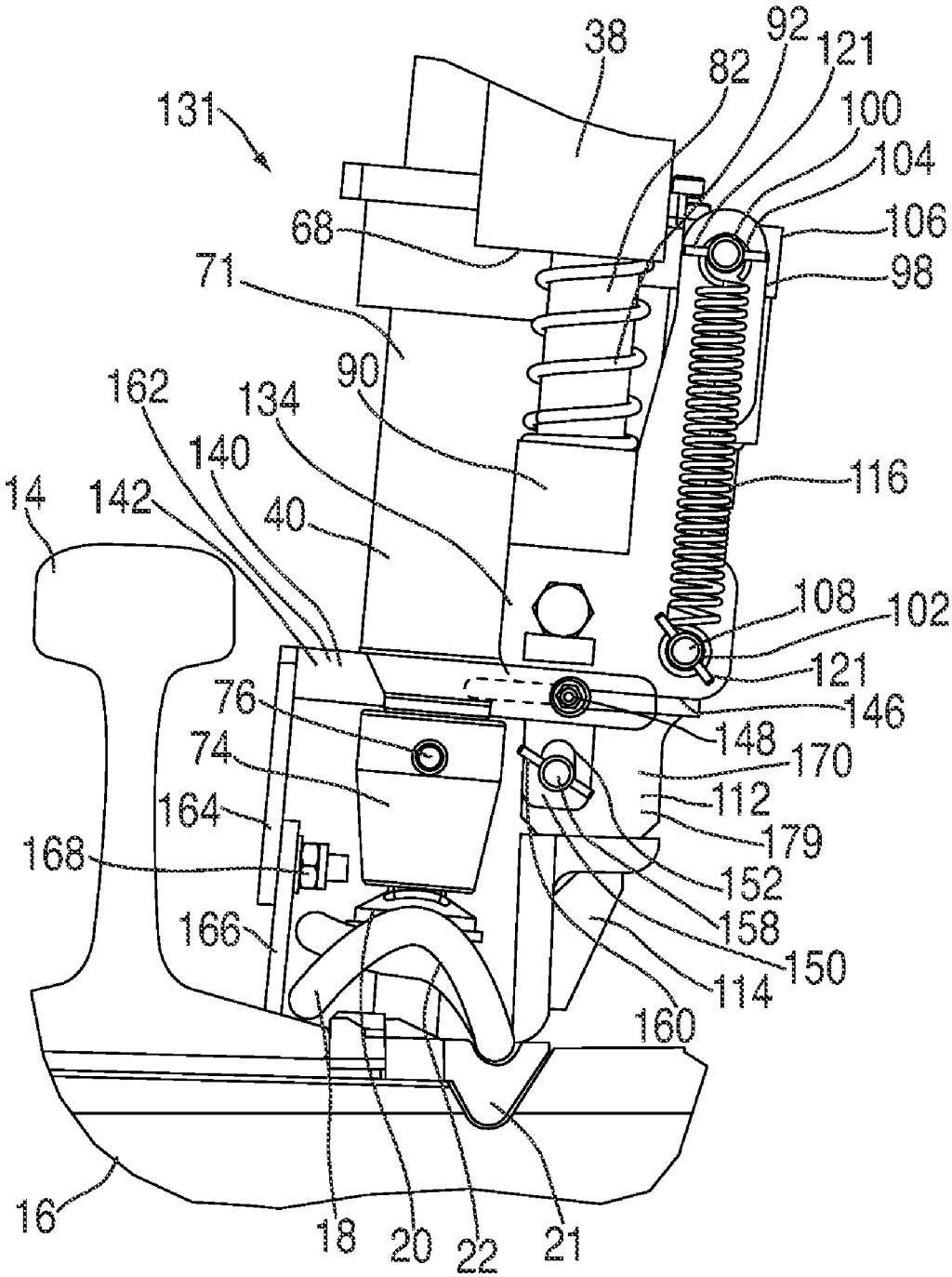
FIG. 11 is a side view of an alternate embodiment of an apparatus for applying rail clips onto concrete rail ties, with the retention bracket in the retracted position.
Figure 12:
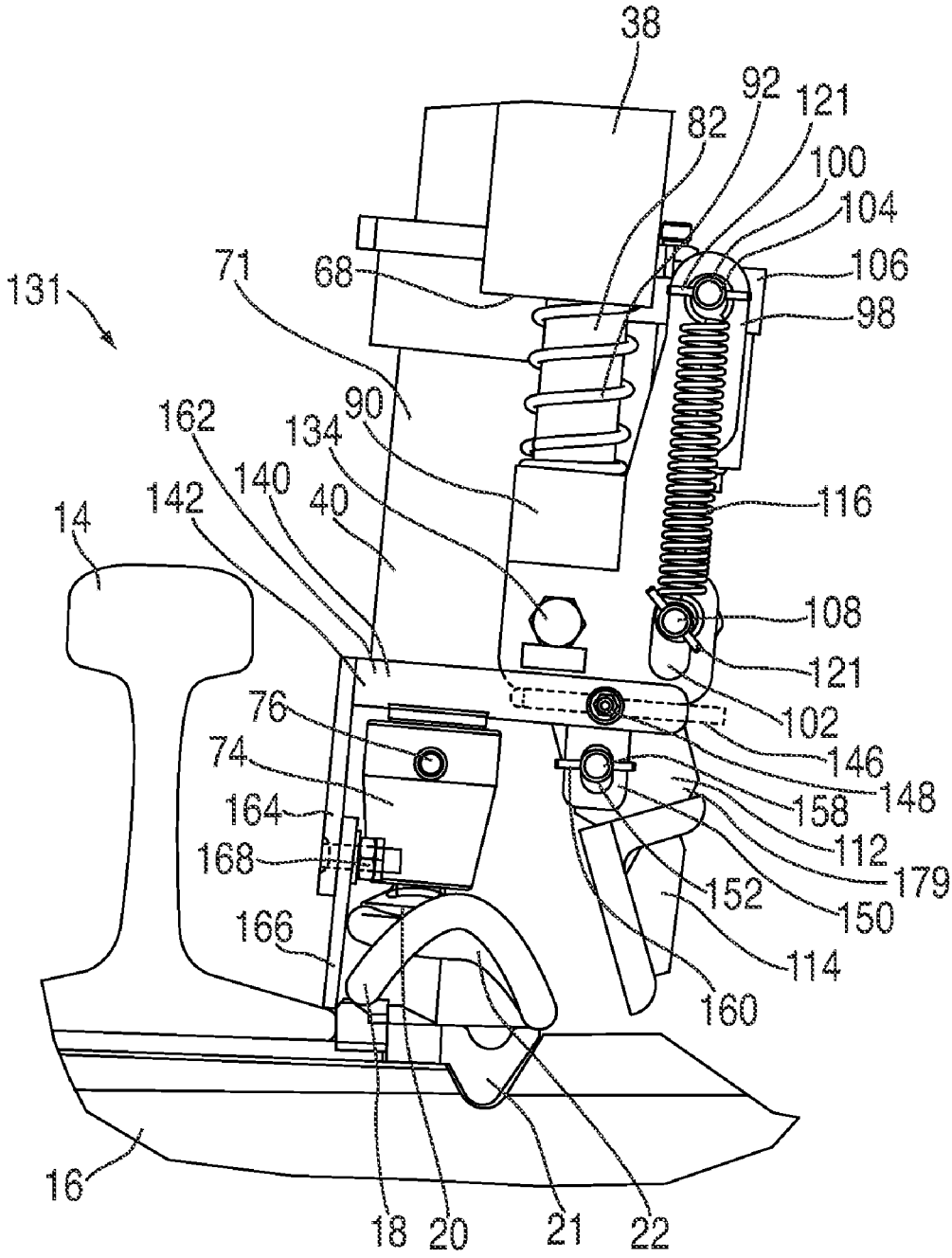
FIG. 12 is a side view of the apparatus of FIG. 11, with the retention bracket in the clip engaging position.
Figure 13:
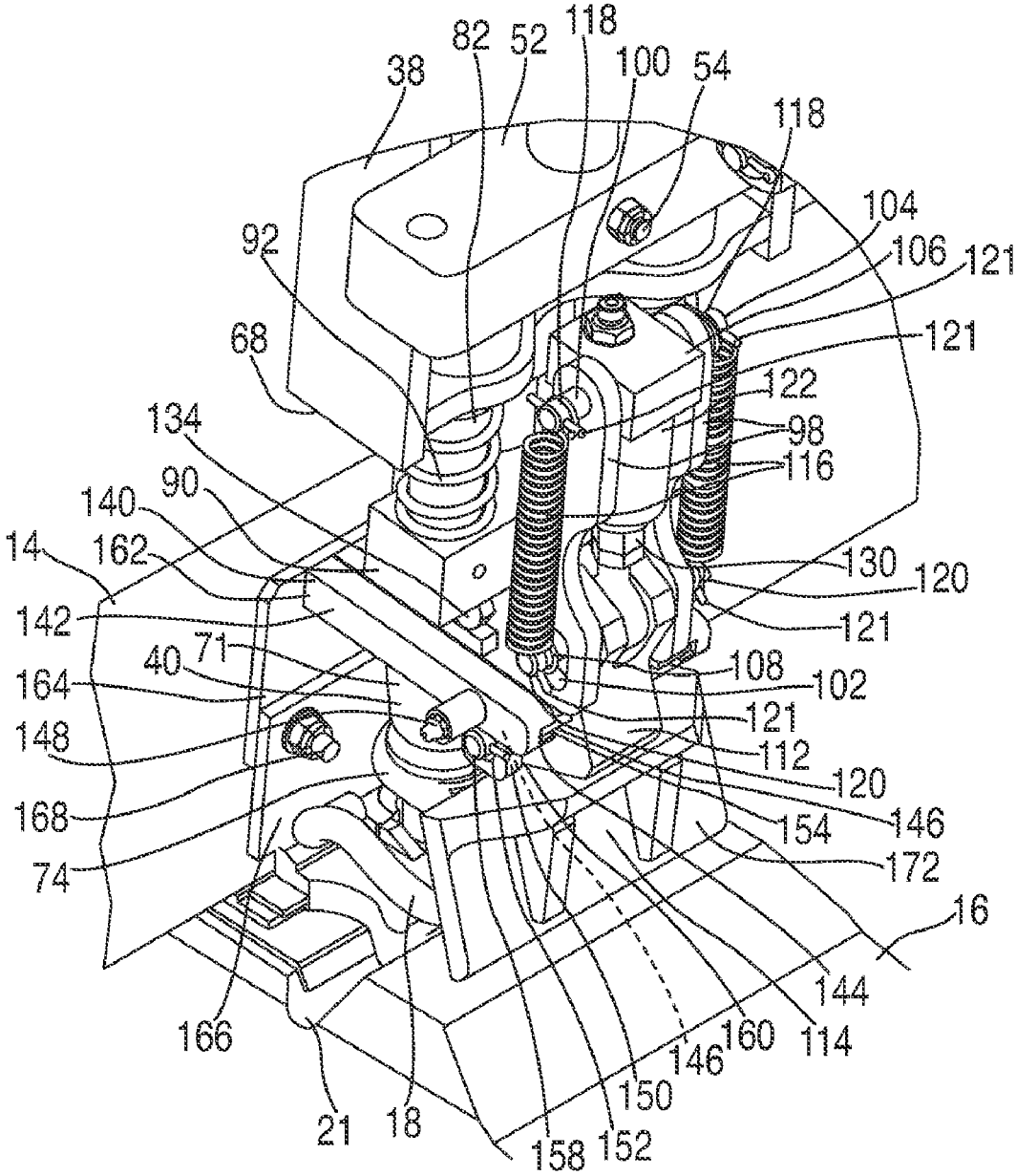
FIG. 13 is a side perspective view of the apparatus of FIG. 11, with the retention bracket in the clip engaging position.

Referring now to FIGS. 11-13, an alternate embodiment is depicted and generally designated 130. Components shown with the apparatus 10 are designated with identical reference numbers. The apparatus 130 includes a retention bracket 140, which is "L"-shaped when viewed from the side. Included on the retention bracket 140 is least one and preferably two sliding portions 142, each having a generally "U"-shaped, laterally opening track 144 (FIG. 13) for slidingly engaging a protruding and complementary generally parallel strip 146 disposed on the fins 90. An oil-fill nozzle 148 is disposed on each sliding portion 142 for adding oil or other lubricant to facilitate movement of the track 144 along the strip 146. Each sliding portion 142 further includes a depending guide portion 150 with a laterally facing guide opening 152, both located near a first end 154 of the sliding portion 142. A guide rod 158 is disposed parallel to a rail web **14*a* of the rail 14 and is aligned such that it passes through an opening 156 (FIG. 4**)

in the paddle bracket 112 and the guide openings 152. Guide pins 160 are used at each end of the guide rod 158 to secure the guide rod in position. Affixed to a second end 162 of the sliding portion 142 is a generally planar guide surface 164 oriented to be generally coplanar with the rail. A generally planar plate 166 is attached to the guide surface 164 using at least one fastener 168.

The retention bracket 140 is configured to move between a retracted position (FIG. 11) and a clip engaging position (FIG. 12), the position of the bracket being dependent upon the position of the paddle 114. More specifically, the retention bracket 140 is movable transversely to the rail 14 through a pivot connection to the paddle bracket 112. When the paddle 114 is in the rail clip engaging position (FIG. 12), the guide rod 158 is positioned such that it provides a force on the retention bracket 140 in a direction towards the rail 14. As such, the retention bracket 140 (including the guide surface 164 and the plate 166) moves to the retracted position, (i.e., away from the clip 18 and towards the rail 14). When the paddle 114 moves into the withdrawn position, the rotation of the paddle bracket 112 draws the guide rod 158 transversely away from the rail 14, thereby pulling the retention bracket 140 towards the clip 18, into the clip engaging position, and thus pushing the clip from its rail engaging position. When the retention bracket 140 is in the clip engaging position, the plate 166 grippingly engages the clip 18. Movement of the retention bracket 140 is facilitated by movement of the track 144 along the strip 146.

Preferably, the guide opening 152 is generally oval-shaped allowing the guide rod 158 to move within the guide opening as the paddle moves between the rail clip engaging position and the withdrawn position. When the paddle 114 is in the rail clip engaging position, the guide rod 158 is positioned at a lower end of the guide opening 152. As the paddle 114 moves into the withdrawn position, the guide rod 158 moves into an upper end of the guide opening 152 as the paddle pivots about the bolt 134 (FIG. 4). The vertical movement of the guide rod 158 translates into horizontal movement of the retention bracket 140 resulting from the movement of the guide rod 158 within the guide opening 152 as previously discussed.

The retention bracket 140 provides several advantages. First, as a rail clip 18 is applied to the rail tie 16 by driving the fastener 20 through the fastener opening 22, the plate 166 on the retention bracket 140 prevents the clip from rotating about the fastener. Further, as the plate 166 becomes worn over time, it can be easily replaced by removing the fastener 168 and replacing the part.

In addition, the retention bracket 140 aids in the removal of the clip 18 and the fastener 20. The removal process is performed by the apparatus 130 by performing the clip-application steps described in detail above in reverse order. The retention bracket 140 however, provides an additional benefit during the removal process. Specifically, as the paddle 114 moves into the withdrawn position (and the retention bracket 140 moves into the clip engaging position), the plate 166 exerts a force on the clip 18 towards the fastener 20. This force results in a slight lifting of the clip 18 which aids in removal of the clip.

Referring now to FIGS. 4 and 13, the paddle bracket 112 and the paddle 114 are collectively referred to as the paddle mechanism 170. Included on the paddle bracket 112 is a housing 172 having a pair of spaced ears 174 each with the transverse bore 133, the bores of adjacent ears being in registry with each other. A generally U-shaped slot 178 separates the ears 174. The throughbore 136 is located on an opposite side of the housing 172 from the ears 174. In the preferred embodiment, the ears 174 are triangular or wedge-shaped, and point laterally away from the rail 14.

Attached as by welding to the housing 172 is the generally "L"-shaped paddle 114, thereby securing the paddle to a lower end 179 of the bracket. Included on the paddle 114 is a first, horizontal panel 180 and a second, vertical panel 182 joined together along a common edge 184. The vertical panel 182 performs the work of pushing the clip 18 into position. At least one and preferably two triangular gussets 186 support the paddle and connecting the first and second panels 180, 182. As is known in the art, the configuration and placement of the gussets 186 may vary to suit the situation.

Figure 14:
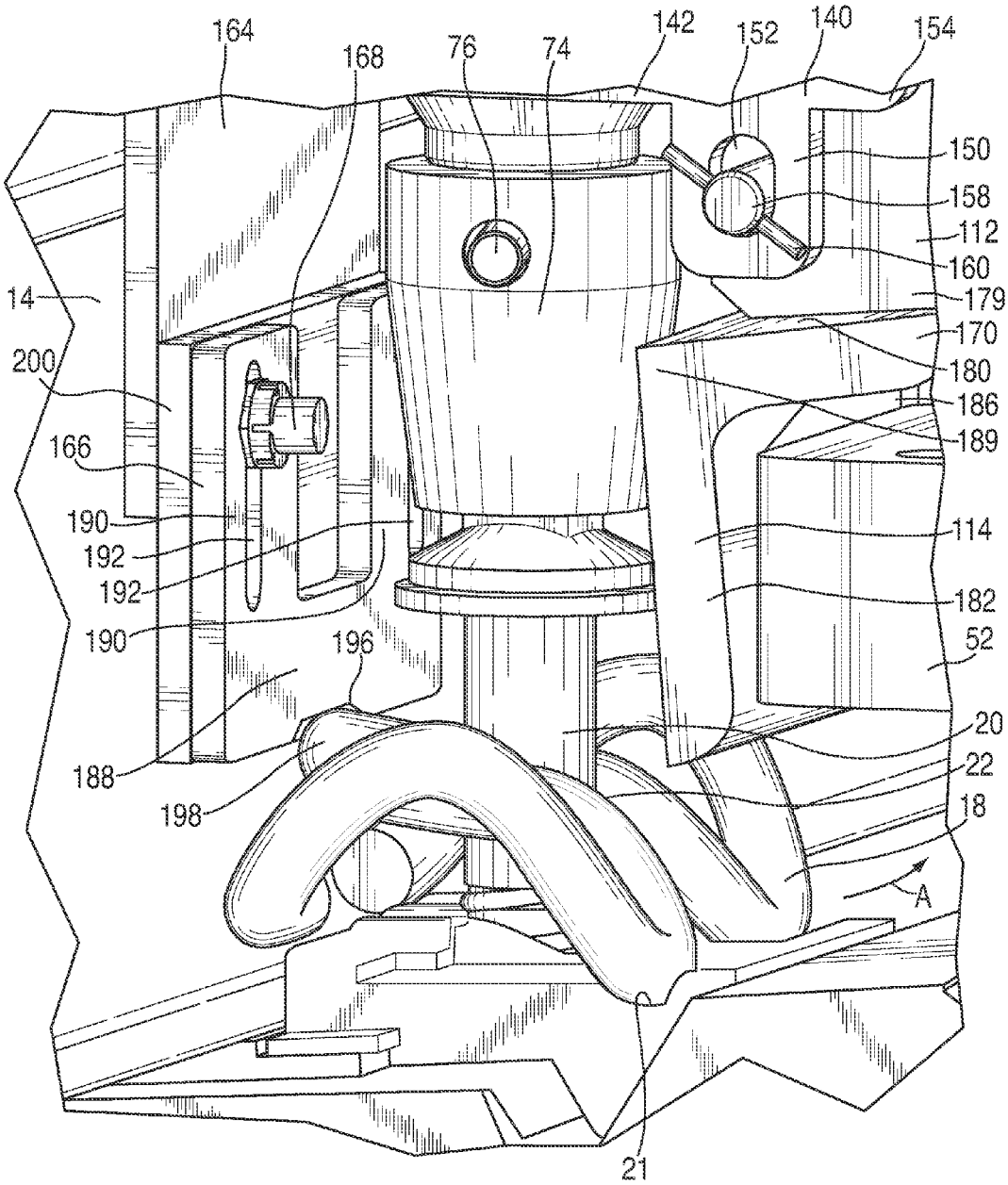
FIG. 14 is another side perspective view of the apparatus of FIG. 11.
Figure 15:
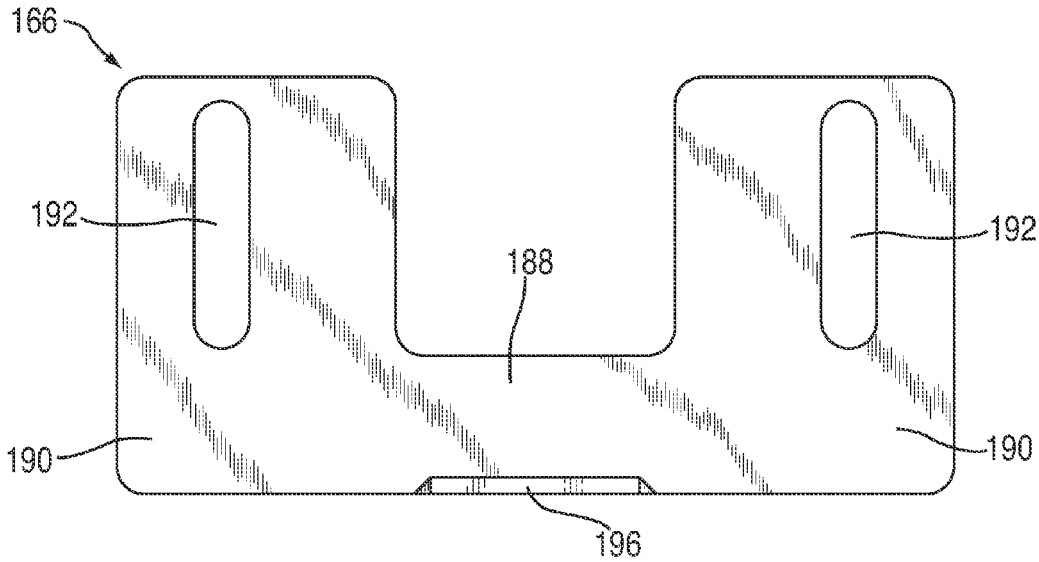
FIG. 15 is a front view of a plate of the apparatus of FIG. 14.
Figure 16:
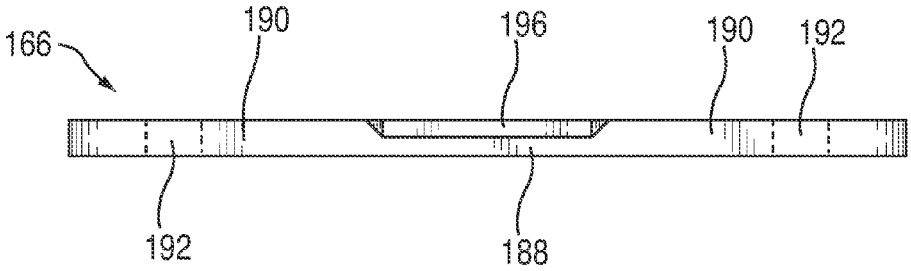
FIG. 16 is a bottom view of the same.

Referring now to FIGS. 14-16, the plate 166 is now shown in greater detail in FIGS. 14-16. The plate 166 is generally planar, has a generally "U"-shaped body and has a base portion 188 connecting two spaced end portions 190. At least one elongated opening 192 is disposed on each end portion 190 and is configured for accommodating the corresponding plate fastener 168 for securing the plate 166 to the guide surface 164. A chamfered clip recess 196 is disposed on a lower edge of the base portion 188 between the end portions 190 for providing better engagement between the plate 166 and a middle portion 198 of the clip 18 when the retention bracket 140 is in the clip engaging position (FIG. 14). This engagement causes the clip 18 to slightly rotate counter clockwise, in the direction indicated by an arrow A, thereby allowing the clip to move away from the rail 14 without interference from the formation 21. Preferably, a spacer 200 (FIG. 14) made of rubber or another suitable resilient material is positioned between the plate 166 and the guide surface 164 to reduce the likelihood of damage caused by environmental obstructions.

While particular embodiments of the present apparatus for applying and removing rail clips onto rail ties has been described herein, it will be appreciated by those skilled in the art that changes and modifications may be made thereto without departing from the invention in its broader aspects and as set forth in the following claims.

The invention claimed is:

1. An apparatus for applying or removing individual rail clips to secure a rail onto a rail tie comprising:

a frame;

an operator workstation disposed on said frame;

at least one workhead assembly constructed and arranged to move relative to said frame;

at least one fastener assembly disposed on said workhead assembly for securing, by axially rotating, a fastener to fasten the rail clip to the tie;

at least one paddle assembly disposed on said workhead assembly for working in conjunction with said fastener assembly to push a clip in position for holding the rail to the tie; and said fastener assembly is configured to move generally vertically relative to said workhead assembly between a fastener loosening position and a fastener tightening position.

2. The apparatus of claim 1 wherein said at least one paddle assembly is movable relative to the tie independently of said at least one fastener assembly.

3. The apparatus of claim 2 wherein said paddle assembly further includes a paddle configured for being urged against the rail tie when said fastener assembly moves vertically downward toward the rail tie as a rail fastener is tightened.

4. The apparatus of claim 1 further including a cylinder mounting bracket forming a common mount of said paddle assembly and said fastener assembly, said paddle assembly including a paddle bracket constructed and arranged for pivoting relative to said mounting bracket.

5. The apparatus of claim 4 wherein said fastener assembly further includes a drive shaft and said paddle is moveable between a withdrawn position and a clip engaging position when said fastener assembly is in a ready position.

6. The apparatus of claim 4 wherein said paddle assembly further includes a fluid power cylinder for moving said paddle bracket between said withdrawn position and said clip engaging position.

7. The apparatus of claim 1 wherein said paddle assembly is constructed and arranged to be vertically adjustable relative to said fastener assembly.

8. The apparatus of claim 1 wherein a first workhead assembly is constructed and arranged to move independently of a second workhead assembly.

9. The apparatus of claim 1 wherein said paddle assembly includes a paddle, and said apparatus further comprising a retention bracket associated with said paddle assembly and configured for moving between a retracted position and a clip engaging position determined by a position of said paddle.

10. The apparatus of claim 9 wherein said paddle assembly includes a strip and said retention bracket includes a track for slidingly engaging said strip.

11. The apparatus of claim 9 wherein said retention bracket includes a guide surface configured to engage said clip when said retention bracket is in said clip engaging position.

12. An apparatus for applying or removing rail clips onto rail ties comprising:

a frame;

at least one workhead assembly constructed and arranged to move relative to said frame;

at least one fastener assembly disposed on said workhead assembly;

at least one paddle assembly disposed on said workhead assembly; and at least one paddle included on said paddle assembly and being biased towards the rail tie;

wherein said at least one fastener assembly and said at least one paddle assembly are both positioned on the same side of the rail.

13. The apparatus of claim 12 wherein said paddle assembly is moveable relative to the ties independently of said fastener assembly.

14. The apparatus of claim 13 further comprising an operator workstation disposed on said frame and configured for controlling operation of said workhead assembly.

15. An apparatus for applying or removing rail clips to secure a rail onto a rail tie comprising:

a frame;

an operator workstation disposed on said frame;

at least one workhead assembly constructed and arranged to move relative to said frame;

at least one fastener assembly disposed on said workhead assembly;

at least one paddle mechanism including a paddle, disposed on said workhead assembly for working in conjunction with said fastener assembly to push a clip in position for holding the rail to the tie; and a retention bracket connected to said paddle mechanism and configured for moving relative to said at least one fastener assembly between a retracted position and a clip engaging position determined by a position of said paddle.

16. An apparatus for applying or removing individual rail clips to secure a rail onto a rail tie comprising:

a frame;

an operator workstation disposed on said frame;

at least one workhead assembly constructed and arranged to move relative to said frame;

at least one fastener assembly disposed on said workhead assembly for securing, by axially rotating, a fastener to fasten the rail clip to the tie; and at least one paddle assembly disposed on said workhead assembly for working in conjunction with said fastener assembly to push a clip in position for holding the rail to the tie; and said at least one paddle assembly is movable relative to the tie independently of said at least one fastener assembly.

17. The apparatus of claim 16 wherein said paddle assembly further includes a paddle configured for being urged against the rail tie when said fastener assembly moves vertically downward toward the rail tie as a rail fastener is tightened.

18. An apparatus for applying or removing individual rail clips to secure a rail onto a rail tie comprising:

a frame;

an operator workstation disposed on said frame;

at least one workhead assembly constructed and arranged to move relative to said frame;

at least one fastener assembly disposed on said workhead assembly for securing, by axially rotating, a fastener to fasten the rail clip to the tie;

at least one paddle assembly disposed on said workhead assembly for working in conjunction with said fastener assembly to push a clip in position for holding the rail to the tie; and a cylinder mounting bracket forming a common mount of said paddle assembly and said fastener assembly, said paddle assembly including a paddle bracket constructed and arranged for pivoting relative to said mounting bracket.

19. The apparatus of claim 18 wherein said fastener assembly further includes a drive shaft and said paddle is moveable between a withdrawn position and a clip engaging position when said fastener assembly is in a ready position.

20. An apparatus for applying or removing individual rail clips to secure a rail onto a rail tie comprising:

a frame;

an operator workstation disposed on said frame;

at least one workhead assembly constructed and arranged to move relative to said frame;

at least one fastener assembly disposed on said workhead assembly for securing, by axially rotating, a fastener to fasten the rail clip to the tie;

at least one paddle assembly disposed on said workhead assembly for working in conjunction with said fastener assembly to push a clip in position for holding the rail to the tie; and said paddle assembly includes a paddle, and said apparatus further comprising a retention bracket associated with said paddle assembly and configured for moving between a retracted position and a clip engaging position determined by a position of said paddle.

* * * * *